US006723930B2

(12) United States Patent
Minami

(10) Patent No.: US 6,723,930 B2
(45) Date of Patent: Apr. 20, 2004

(54) MIRROR SWITCH DEVICE

(75) Inventor: Keiji Minami, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/320,643

(22) Filed: Dec. 17, 2002

(65) Prior Publication Data

US 2003/0117255 A1 Jun. 26, 2003

(30) Foreign Application Priority Data

Dec. 25, 2001 (JP) ..... P2001-391418

(51) Int. Cl.[7] ..... H01H 25/04

(52) U.S. Cl. ..... 200/6 A; 200/5 R

(58) Field of Search ..... 200/6 R, 6 A, 200/17 R, 18, 5 R

(56) References Cited

U.S. PATENT DOCUMENTS

| | | | | | |
|---|---|---|---|---|---|
| 4,795,862 | A | * | 1/1989 | Linden | 200/6 A |
| 5,555,004 | A | * | 9/1996 | Ono et al. | 345/161 |
| 5,689,095 | A | * | 11/1997 | Kawase | 200/5 R |
| 6,344,618 | B1 | * | 2/2002 | Sato | 200/6 A |

* cited by examiner

*Primary Examiner*—Michael A. Friedhofer
(74) *Attorney, Agent, or Firm*—Morgan, Lewis & Bockius LLP

(57) ABSTRACT

On a printed wiring board (13), switch parts (21 to 24) are disposed so as to correspond to four positions of corner parts in the side parts of a rectangular form of a pusher (20). A switch circuit member is provided. The switch circuit member includes the first to fourth switch parts and a plurality of resistances connected together between a pair of terminals and a resistance value between the pair of terminals is changed for each of different switch operation patterns of the switch parts in accordance with the pressing operations of the side parts of the pusher.

2 Claims, 9 Drawing Sheets

MIRROR SWITCH DEVICE

BACKGROUND OF THE INVENTION

The present invention relates to a mirror switch device provided with four switch parts.

FIGS. 12 to 14 show a general mirror switch device 1. In this mirror switch device 1, the upper, lower right and left parts of an operating knob 2 are adapted to be respectively pressed and operated. On the back surface side of the operating knob 2, a substantially rectangular plate shaped pusher 3 (see a two-dot chain line in FIG. 13 and a solid line in FIG. 14) is provided. Further, on the back surface side of the pusher 3, a pressure member unit 4 made of rubber is provided. On the pressure member unit 4, six elastic pressure members 4*a* to 4*f* are formed by an integral molding. On the back surface side of the elastic pressure members 4*a* to 4*f*, a printed wiring board 5 is arranged. Switch parts 6A to 6F are respectively disposed so as to correspond to the elastic pressure members 4*a* to 4*f*. The switch parts 6A to 6F have the same structures. One of them, for instance, the switch part 6C is described. As shown in FIGS. 13 and 14, the switch part 6C comprises a movable contact 6Ca provided on the back surface of the elastic pressure member 4*c* and fixed contacts 6Cb and 6Cc provided on the printed wiring board 5.

In this switch part 6C, when the elastic pressure member 4*c* is pressed down, the movable contact 6Ca allows both the fixed contacts 6Cb and 6Cc to be electrically conducted (on) to each other, and when the elastic pressure member 4*c* is returned, the movable contact 6Ca allows both the fixed contacts 6*cb* and 6Cc to be disconnected (off) from each other.

When the upper part of the operating knob 2 is pressed and operated, the two elastic pressure members 4*a* and 4*b* are pressed down to turn on both the switch parts 6A and 6B. Thus, a mirror motor not shown in the drawing is energized and driven to move a mirror upward. When the right part of the operating knob 2 is likewise pressed and operated, the two elastic pressure members 4*c* and 4*d* are pressed down to turn on both the switch parts 6*c* and 6D. When the lower part of the operating knob 2 is pressed and operated, the two elastic pressure members 4*d* and 4*e* are pressed down to turn on both the switch parts 6D and 6E. When the left part of the operating knob 2 is pressed and operated, the two elastic pressure members 4*f* and 4*a* are pressed down to turn on both the switch parts 6F and 6A.

However, in the above-described structure, there is a disadvantage in which the number of the switch parts 6A to 6F is increased, and the number of the elastic pressure members is increased. Further, there is an inconvenience in which a certain switch operation is not obtained. That is, for instance, when an eccentric position designated by reference character Ph on the upper side part of the pusher 3 in FIG. 13 is pressed and operated, or when even a central position PO is slantingly pressed or operated, the switch parts 6A and 6B should be naturally turned on, however, the switch parts 6B and 6C are undesirably turned on, or the switch parts 6A, 6B and 6C are undesirably turned on.

SUMMARY OF THE INVENTION

The present invention is invented by considering the above-described circumstances and it is an object of the present invention to provide a mirror switch device in which the number of switch parts can be reduced as much as possible, a switch part can be assuredly turned on and the structure of a switch circuit member can be simplified.

The invention relates to a mirror switch device comprising:

- a substantially rectangular pusher having four side parts pressed and operated;
- first to fourth switch parts respectively disposed at four corner positions of side parts of a rectangular form of the pusher and two of the switch parts corresponding to each side part performing a switch operation when each side part of the pusher is pressed and operated; and
- a switch circuit member having the first to fourth switch parts and a plurality of resistances connected together between a pair of terminals and changing a resistance value between the pair of terminals for each of different switch operation patterns of the switch parts in accordance with the pressing operation of each side part of the pusher.

According to the invention, since the switch parts are respectively disposed at the four positions of the corner parts in the side parts of the rectangular form of the pusher, the number of the switch parts can be reduced. In this case, when each side part of the pusher is pressed and operated, since the switch parts are located at both the end parts of each side part, both the switch parts are assuredly pressed and operated to certainly perform a switch operation.

Here, a switch circuit for outputting a signal for moving a mirror upward, downward, rightward and leftward to the four switch parts is required. In the above-described device, since the switch circuit member is provided for changing a resistance value between a pair of terminals for each of different switch operation patterns in accordance with the pressing operation of each side part of the pusher, four resistance value patterns can be obtained between a pair of terminals in accordance with the pressing operations of the four side parts of the pusher. Accordingly, a circuit structure can be made relatively simple.

In this case, the mirror switch device may be constructed in such a manner that the first switch part and the third switch part of the first to fourth switch parts are arranged diagonally and the second switch part and the fourth switch part thereof are arranged diagonally and the switch circuit member comprises a first series circuit connected between the pair of terminals and having the first switch part, a first resistance and the fourth switch part which are sequentially connected; and a second series circuit connected in parallel with the first series circuit and having a second resistance, the third switch part, a third resistance, a fourth resistance and the second switch part which are sequentially connected; and a node between the first switch part and the first resistance in the first series circuit is connected to a node between the third resistance and the fourth resistance in the second series circuit and a node between the first resistance and the fourth switch part in the first series circuit is connected to a node between the third switch part and the third resistance in the second series circuit.

In such a way, the four resistance value patterns can be assuredly obtained from between a pair of terminals in the structure in which two of the four switch parts are selectively turned on.

BRIEF DESCRIPTION OF THE DRAWINGS

FIG. 6 is a view showing a state that the switch parts are partly turned on.

DETAILED DESCRIPTION OF PREFERRED EMBODIMENTS

Figure 1:
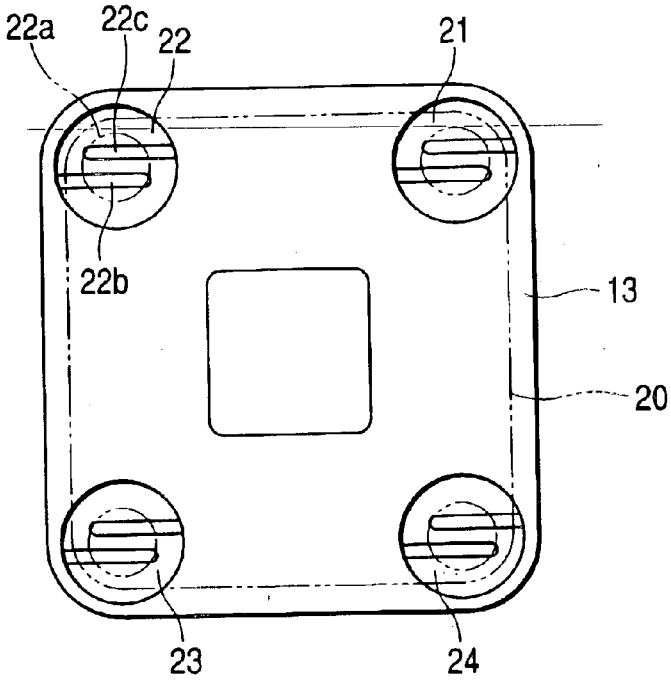
FIG. 1 is a plan view of a printed wiring board showing the arrangement of switch parts in a first embodiment of the present invention.
Figure 2:
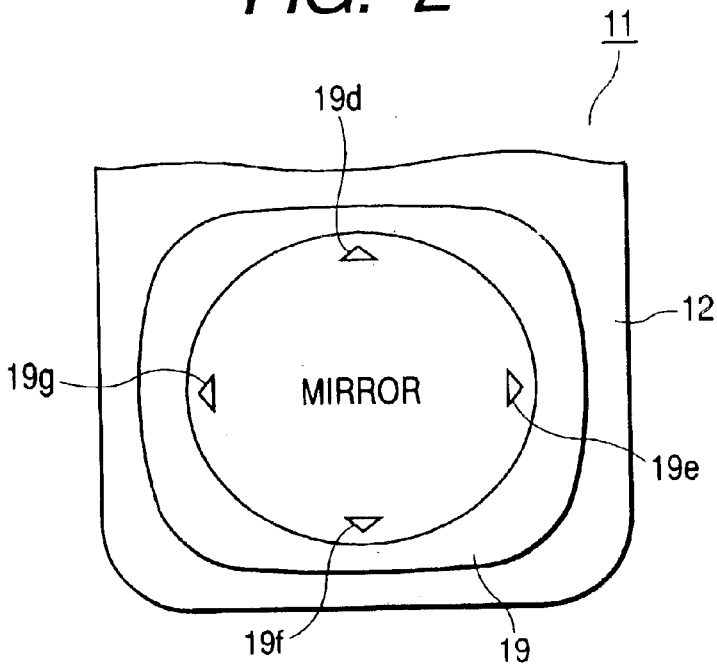
FIG. 2 is a plan view of a mirror switch device.
Figure 3:
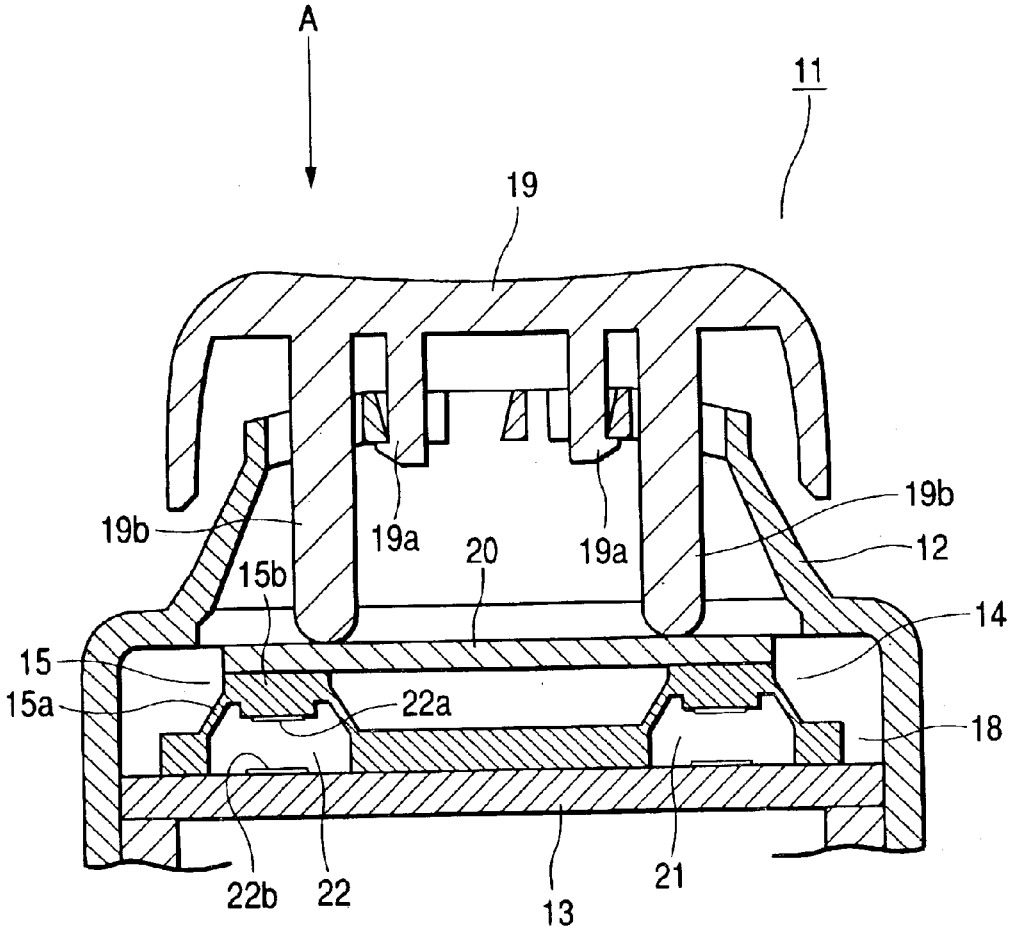
FIG. 3 is a longitudinally sectional side view of the mirror switch device.
Figure 4:
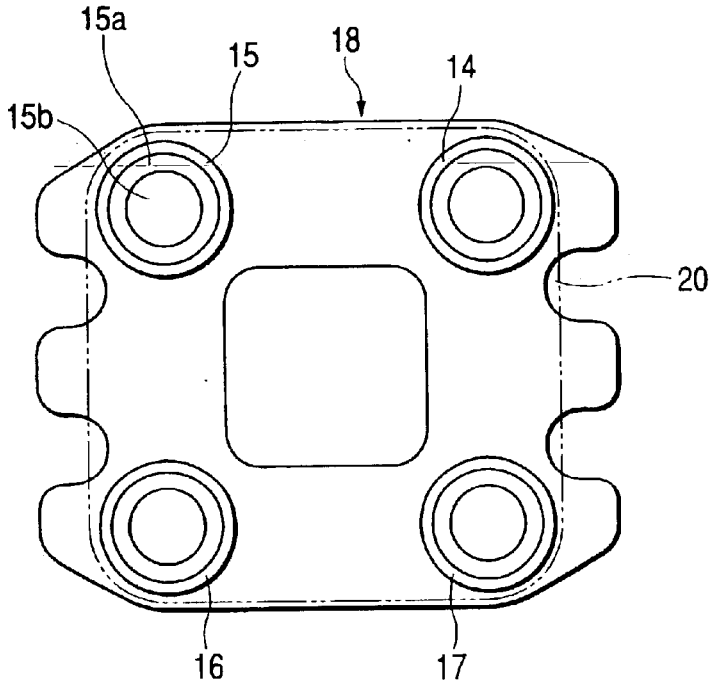
FIG. 4 is a plan view of a pressure member unit.

Now, a first embodiment will be described by referring to FIGS. 1 to 10. Initially, FIG. 2 shows a mirror switch device 11 viewed from a front side. In FIGS. 2 and 3, a printed wiring board 13 as a circuit board is disposed in a switch case 12. On the printed wiring board 13, a pressure member unit 18 having first to fourth elastic pressure members 14 to 17 is arranged. This pressure member unit 18 is made of rubber, and accordingly, the elastic pressure members 14 to 17 are also respectively made of rubber.

Then, the four elastic pressure members 14 to 17 are respectively configured to a dome shape. The elastic pressure member 15 as one of them is described. This elastic pressure member 15 has an operated part 15*b* at the top part of a thin rising part 15*a*. The operated part 15*b* receives a pressure force in the direction of an arrow mark A in FIG. 3 to move toward the direction (see FIG. 6) while the rising part 15*a* is deformed. When the pressure force is released, the part 15*b* is returned to its original position due to the elastic restoring force of the rising part 15*a*.

Figure 5:
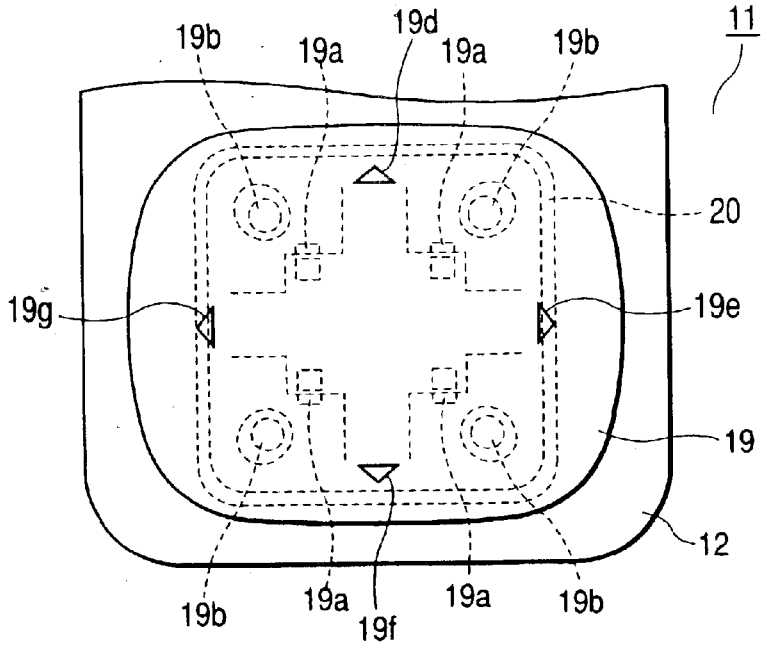
FIG. 5 is a plan view of the mirror switch device showing an operating knob passing through it.

A pusher 20 to be pressed and operated by an operating knob 19 is provided in the side of operated parts 14*b* to 17*b* of the elastic pressure members 14 to 17. This pusher 20 has a substantially rectangular form as shown by a two-dot chain line in FIG. 4. The operating knob 19 is provided in the switch case 12 so that the upper, lower, right and left sides thereof can be respectively pressed and operated as shown in FIGS. 3 and 5. The operating knob 19 is prevented from slipping out by means of claw parts 19*a*. Pressing leg parts 19*b* are formed from the back surfaces of the four corners of the operating knob 19 and the end parts thereof abut on the pusher 20. Accordingly, the upper, lower, right and left side parts of the pusher 20 are respectively likewise pressed and operated in accordance with the pressing operation of the operating knob 19. The pusher 20 and the operating knob 19 are returned to their original positions due to the elastic return of the elastic pressure members 14 to 17. On the operating knob 19, marks 19*d*, 19*e*, 19*f* and 19*g* showing operating points are provided.

The elastic pressure members 14 to 17 are respectively arranged at the corner parts of the side parts of the rectangular form of the pusher 20. In this case, the first elastic pressure member 14 and the third elastic pressure member 16 are disposed diagonally and the second elastic pressure member 15 and the fourth elastic pressure member 17 are disposed diagonally.

First to fourth switch parts 21 to 24 are provided so as to correspond to the elastic pressure members 14 to 17, so that there exists a diagonal relation between the first switch part 21 and the third switch part 23 and there exists a diagonal relation between the second switch part 22 and the fourth switch part 24. Since the switch parts 21 to 24 have the same structures, the switch part 22 is representatively described below.

The switch part 22 comprises the above-described elastic pressure member 15, a movable contact plate 22*a* attached to the back surface of the operated part 15*b* of the elastic pressure member 15 and fixed contact parts 22*b* and 22*c* formed on the printed wiring board 13 so as to be opposed to the movable contact plate. The movable contact plate 22*a* electrically connects both the fixed contact parts 22*b* and 22*c* each other to turn on the switch part 22.

A switch circuit member 25 (see FIG. 7) including the first to fourth switch parts 21 to 24 is formed on the printed wiring board 13. This switch circuit member 25 comprises: a first series circuit 27 connected between a terminal 25*m* and a terminal 25*e* as a pair of terminals and having the first switch part 21, a first resistance 26 (500 Ω) and the fourth switch part 24 which are sequentially connected; and a second series circuit 31 connected in parallel with the first series circuit 27 and having a second resistance 28 (450 Ω), the third switch part 23, a third resistance 29 (500 Ω), a fourth resistance 30 (100 Ω) and the second switch part 22 which are sequentially connected. A node Sa between the first switch part 21 and the first resistance 26 in the first series circuit 27 is connected to a node Sb between the third resistance 29 and the fourth resistance 30 in the second series circuit 31. A node Sc between the first resistance 26 and the fourth switch part 24 in the first series circuit 27 is connected to a node Sd between the third switch part 23 and the third resistance 29 in the second series circuit 31. A signal output circuit (not shown) is connected to the terminals 25*m* and 25*e* for outputting a signal (voltage) in accordance with a resistance value between both the terminals 25*m* and 25*e*. The output signal of the signal output circuit is supplied to a microcomputer for driving a mirror.

Figure 8:
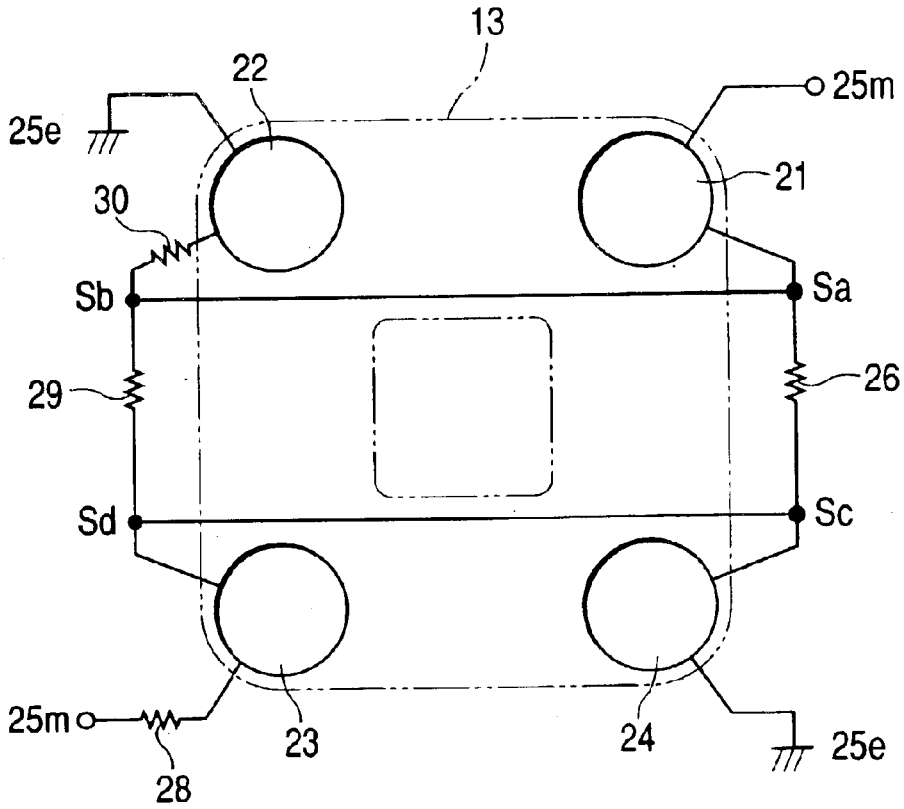
FIG. 8 is a view schematically showing the connection of the switch parts and respective resistances.

FIG. 8 shows the arrangement of the first to fourth switch parts 21 and 24 and the relation of the connection between these switch parts 21 to 24 and the respective resistances 26, 27, 29 and 30.

Figure 6:
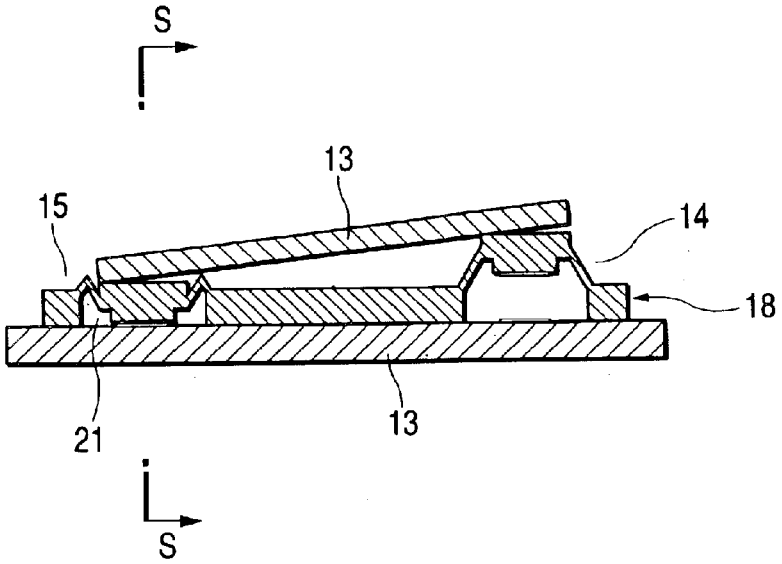
Figure 9:
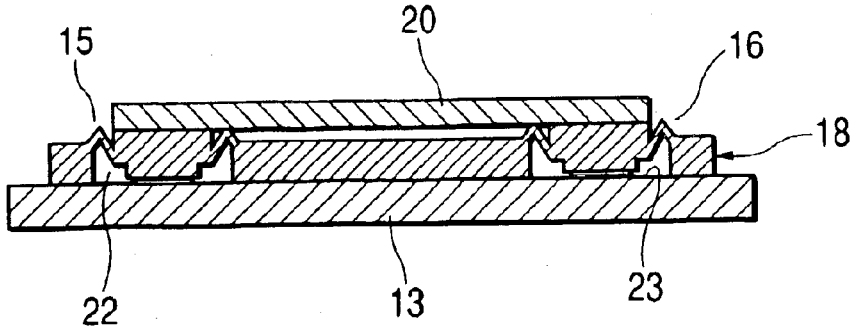
FIG. 9 is a sectional view taken along a line S—S of FIG. 6.

In the above described structure, when a user presses the mark 19*g* in the left part of the operating knob 19, the left side part of the pusher 20 is displaced as shown in FIG. 6. Thus, as shown in FIG. 9, the left side part of the pusher 20 causes the elastic pressure members 15 and 16 to be deformed, so that the second switch part 22 and the third switch part 23 are turned on.

In this case, according to this embodiment, since the elastic pressure members 15 and 16 of the switch parts 22 and 23 are located at the two positions of both the corner parts in the left side part of the pusher 20, even when the left side part is slightly slantingly pressed and operated or an eccentric position is pressed and operated, the elastic pressure members 15 and 16 at the two positions of both the corner parts corresponding to the left side part are substantially equally pressed. As a result, the switch parts 22 and 23 are assuredly operated.

Figure 10A:
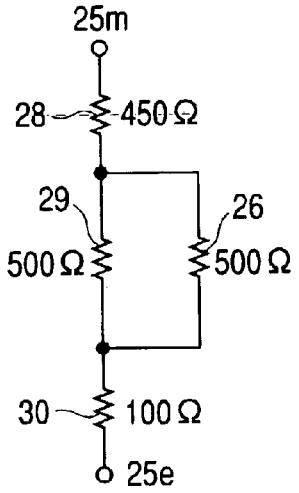
FIGS. 10A to 10D show patterns of changes in combined resistance value in accordance with a switch operation.

When the switch parts 22 and 23 are turned on, as shown in FIG. 10A, the resistance value between the terminal 25*m* and the terminal 25*e* is a combined resistance value (in this case, 800 Ω) of the second resistance 28 (450 Ω) and the third resistance 29 (500 Ω) and the first resistance 26 (500 Ω) in parallel therewith and the fourth resistance (100 Ω).

Figure 10B:
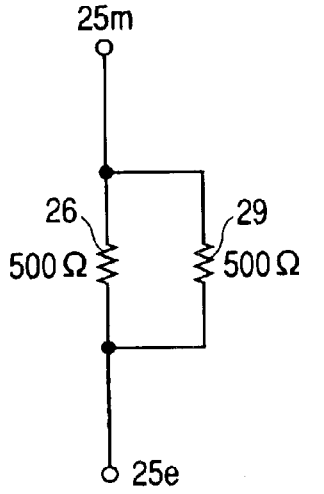

When the right side part of the pusher 20 is pressed and operated, the first switch part 21 and the fourth switch part 24 are turned on, and as shown in FIG. 10B, the resistance value between the terminal 25*m* and the terminal 25*e* is a combined resistance value (in this case, 250 Ω) of the first resistance 26 (500 Ω) and the third resistance 29 (500 Ω) in parallel therewith.

Figure 10C:
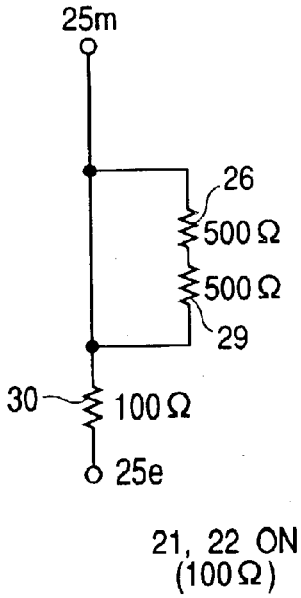

When the upper side part of the pusher 20 is pressed and operated, the first switch part 21 and the second switch part 22 are turned on, and as shown in FIG. 10C, the resistance value between the terminal 25*m* and the terminal 25*e* is a resistance value (100 Ω) of the fourth resistance 30.

Figure 10D:
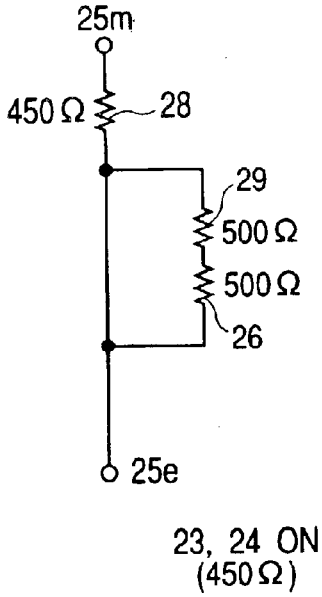

When the lower side part of the pusher 20 is pressed and operated, the third switch part 23 and the fourth switch part 24 are turned on, and accordingly, as shown in FIG. 10D, the resistance value between the terminal 25*m* and the terminal 25*e* is a resistance value (450 Ω) of the second resistance 28.

As described above, according to this embodiment, since the switch parts 21 to 24 are respectively arranged at the four positions of the corner parts in the side parts of the rectangular form of the pusher 20, the number of switch parts can be reduced. In this case, when each side part of the pusher 20 is pressed and operated, since the switch parts are located at both the end parts of each side part, both the switch parts are assuredly pressed and operated to certainly perform a switch operation.

According to this embodiment, since the switch circuit member 25 is provided for changing the resistance value between a pair of terminals 25*m* and 25*e* for each of the switch operation patterns, four resistance value patterns can be obtained between the pair of terminals 25*m* and 25*e* in accordance with the pressing operations of the four side parts of the pusher 20 and a relatively simple circuit structure can be realized.

Figure 7:
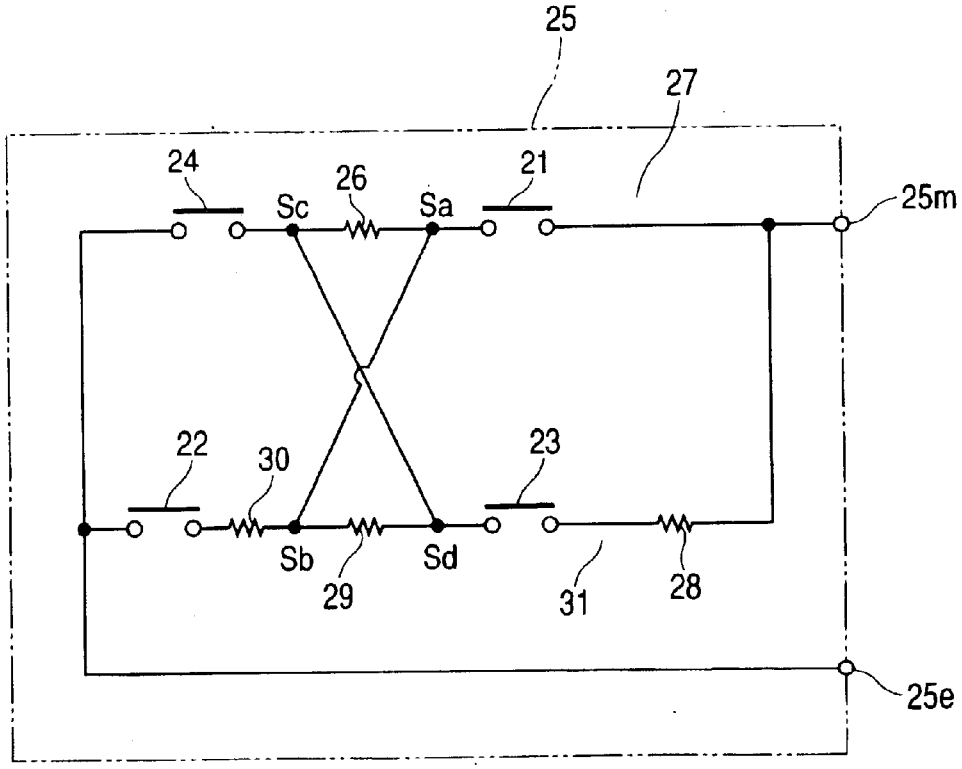
FIG. 7 is a circuit diagram of a switch circuit member.

According to the present embodiment, since the first switch part 21 and the third switch part 23 of the first to fourth switch parts 21 to 24 are arranged diagonally and the second switch part 22 and the fourth switch part 24 are arranged diagonally, and the switch circuit member 25 comprises the first to fourth switch parts 21 to 24 and the resistances 26, 28, 29 and 30 connected between a pair of terminals 25*m* and 28*e* as shown in FIG. 7, the four resistance value patterns can be assuredly obtained from between a pair of terminals 25*m* and 25*e* in the construction in which the two switch parts of the four switch parts are selectively turned on.

Figure 11:
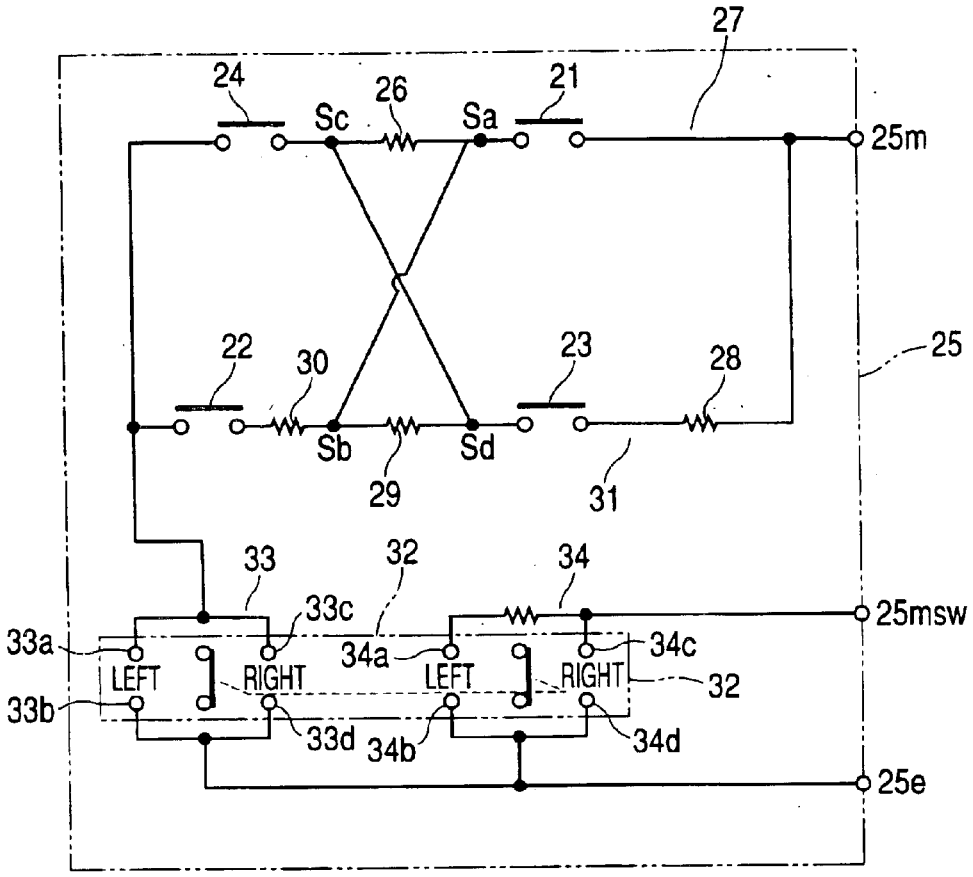
FIG. 11 is a view showing a second embodiment of the present invention corresponding to FIG. 7.
Figure 12:
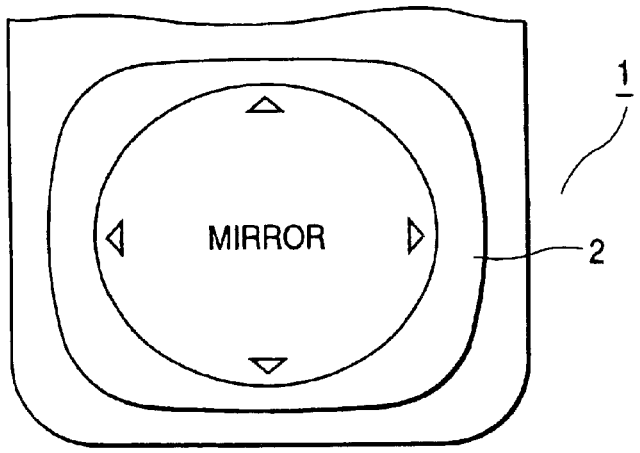
FIG. 12 Prior Art
FIG. 12 is a view showing a conventional example corresponding to FIG. 2.
Figure 13:
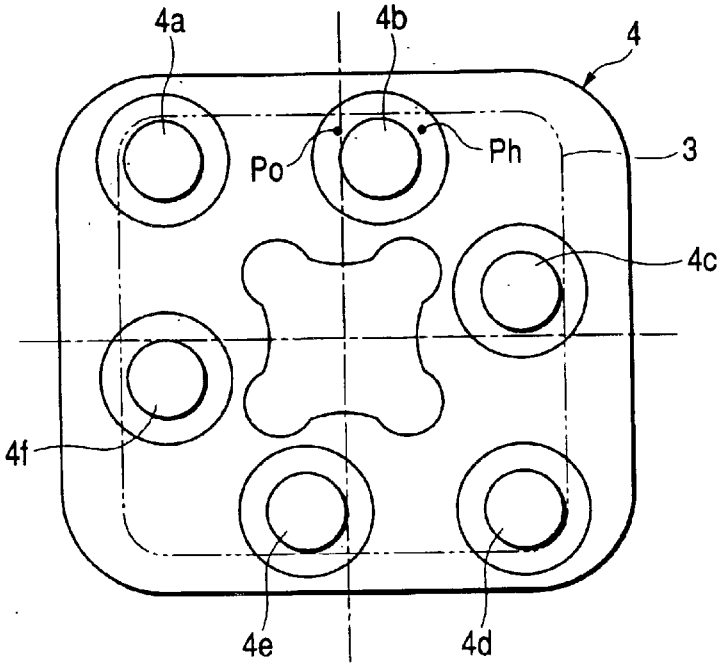
FIG. 13 Prior Art
FIG. 13 is a view corresponding to FIG. 4.
Figure 14:
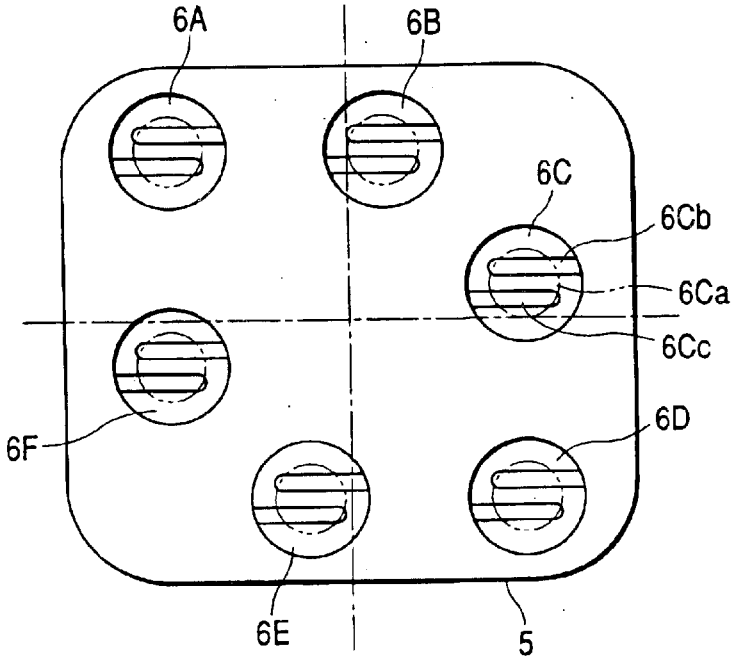
FIG. 14 Prior Art
FIG. 14 is a view corresponding to FIG. 1.
Figure 15:
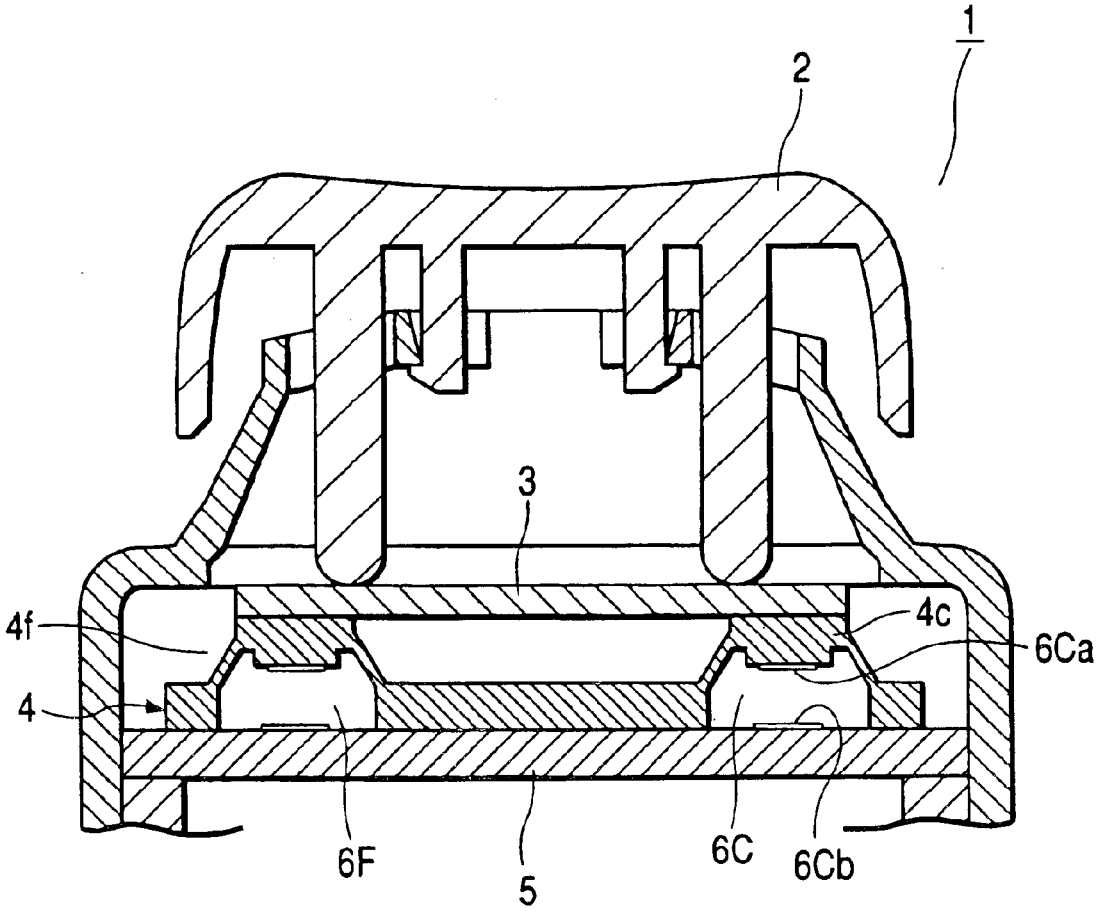
FIG. 15 Prior Art
FIG. 15 is a view corresponding to FIG. 3.

FIG. 11 shows a second embodiment of the present invention. The second embodiment is different from the first embodiment from the viewpoint that a switch 32 for switching a mirror right and left is provided. That is, the switch 32 for switching a mirror right and left includes one switch part 33 and the other switch part 34 interlocking therewith. When an operating member (not shown in the drawing) is operated leftward, contacts 33*a* and 33*b* of the one switch part 33 are electrically conducted to each other and contacts 34*a* and 34*b* of the other switch part 34 are electrically conducted to each other. When the operating member is operated rightward, contacts 33*c* and 33*d* of the one switch part 33 are electrically conducted to each other and contacts 34*c* and 34*d* of the other switch part 34 are electrically conducted to each other. Then, when the operating member is located at a neutral position, any of contacts are opened.

The contacts 33*a* and 33*c* of the one switch part 33 are connected to a common node of the second switch part 22 and the fourth switch part 24. The contacts 33*b* and 33*d* are connected to a terminal 25*e*. Further, the contact 34*a* of the other switch part 34 is connected to a terminal 25*msw* through, for instance, a resistance 35 of 100 Ω. The contact 34*c* is connected to the terminal 25*e*. A signal output circuit is connected to the terminal 25*msw* and the terminal 25*e* for outputting a signal (voltage) in accordance with a resistance value between both the terminals. The output signal of the signal output circuit is connected to a mirror switching circuit for selectively making effective right and left mirror driving circuits.

In the second embodiment, when the operating member (not shown in the drawing) is operated leftward, the contacts 33*a* and 33*b* of the one switch part 33 are electrically conducted to each other and the contacts 34*a* and 34*b* of the other switch part 34 are electrically conducted to each other. Thus, a resistance between the terminal 25*msw* and the terminal 25*e* is 100 Ω. When the operating member is operated rightward, the contacts 33*c* and 33*d* of the one switch part 33 are electrically conducted to each other and the contacts 34*c* and 34 of the other switch part 34 are electrically conducted to each other. Thus, a resistance between the terminal 25*msw* and the terminal 25*e* is 0 Ω. Accordingly, it can be determined as to whether the operating member is operated rightward or leftward.

The present invention is not limited to the above mentioned embodiments, and, for instance, the switch parts 21 to 24 may be composed of other switches such as tact switches.

As apparent from the above description, according to the present invention, there can be achieved excellent effects that the number of switch parts can be reduced, the switch parts can be assuredly turned on and the structure of the switch circuit member can be simplified.

What is claimed is:

1. A mirror switch device comprising:

a substantially rectangular pusher having four side parts for being pressed and operated;

first to fourth switch parts respectively disposed at four corner positions of the side parts of the rectangular form of the pusher, wherein two of the switch parts corresponding to each of the side parts perform a switch operation when each of the side parts of the pusher is pressed and operated; and a switch circuit member including the first to fourth switch parts and a plurality of resistances connected together between a pair of terminals, for changing a resistance value between the pair of terminals for each of different switch operation patterns of the switch parts in accordance with the pressing operation of each of the side parts of the pusher.

2. The mirror switch device according to claim 1, wherein the first switch part and the third switch part are arranged diagonally and the second switch part and the fourth switch part are arranged diagonally, the switch circuit member comprises, a first series circuit connected between the pair of terminals and including the first switch part, a first of the resistances and the fourth switch part which are sequentially connected, and a second series circuit connected in parallel with the first series circuit and including a second of the resistances, the third switch part, a third of the resistances, a fourth of the resistances and the second switch part which are sequentially connected, a node between the first switch part and the first of the resistances in the first series circuit is connected to a node between the third of the resistances and the fourth of the resistances in the second series circuit, and a node between the first of the resistances and the fourth switch part in the first series circuit is connected to a node between the third switch part and the third of the resistances in the second series circuit.

* * * * *